US010306998B2

(12) United States Patent
Meherin

(10) Patent No.: US 10,306,998 B2
(45) Date of Patent: Jun. 4, 2019

(54) DEPLOYABLE MERCHANDISE DISPLAY UNIT

(71) Applicant: CONSOLIDATED SERVICES CONTAINER & DISPLAY, INC., Rancho Cucamonga, CA (US)

(72) Inventor: G. Scott Meherin, Moorpark, CA (US)

(73) Assignee: CONSOLIDATED SERVICES CONTAINER & DISPLAY, INC., Rancho Cucamonga, CA (US)

( * ) Notice: Subject to any disclaimer, the term of this patent is extended or adjusted under 35 U.S.C. 154(b) by 22 days.

(21) Appl. No.: 15/730,570

(22) Filed: Oct. 11, 2017

(65) Prior Publication Data

US 2019/0104867 A1 Apr. 11, 2019

(51) Int. Cl.
*A47F 5/10* (2006.01)
*B65D 5/52* (2006.01)

(52) U.S. Cl.
CPC ..... *A47F 5/101* (2013.01); *B65D 5/52* (2013.01); *B65D 5/5253* (2013.01)

(58) Field of Classification Search
CPC ..... A47F 5/101; A47F 5/114; B65D 25/54; B65D 43/14; B65D 77/042; B65D 2585/88; B65D 5/5038; B65D 5/5445; B65D 5/52; B65D 25/107; B65D 5/5253
See application file for complete search history.

(56) References Cited

U.S. PATENT DOCUMENTS 2,020,876 A * 11/1935 Clark ..... B65D 5/5253 206/746
2,297,115 A * 9/1942 Tyler ..... A47F 5/0062 211/126.1
3,653,495 A * 4/1972 Gray ..... B65D 5/5253 206/746
D268,251 S * 3/1983 Savage ..... D9/415
5,230,423 A * 7/1993 Gellatly ..... B65D 5/52 206/764
5,979,662 A 11/1999 Green
6,050,420 A 8/2000 Green
6,135,289 A * 10/2000 Miller ..... B65D 5/5088 206/470
6,152,305 A 11/2000 Green
6,158,579 A * 12/2000 Rosenbaum ..... B65D 5/48026 206/45.29
6,367,632 B1 8/2002 Green
6,427,842 B1 8/2002 Green
(Continued)

*Primary Examiner* — Ko H Chan
(74) *Attorney, Agent, or Firm* — Stetina Brunda Garred and Brucker

(57) ABSTRACT

A deployable display unit comprises a peripheral wall having a front panel, and a rear panel in opposed relation to each other. The front panel extends from a base plane to define a front height and the rear panel extends from the base plane to define a rear height greater than the front height. At least one product support extends between the front panel and the rear panel, and includes an upper panel, a lower panel, and a pair of side panels extending between the upper and lower panels in opposed relation to each other to define a cavity. The display unit further includes a plurality of slots, with each slot extending through the upper panel and the pair of side panels. The product support is engageable with a plurality of products for sale, wherein each product for sale is received within a respective one of the slots.

22 Claims, 9 Drawing Sheets

(56) References Cited

U.S. PATENT DOCUMENTS

| | | | | |
|---|---|---|---|---|
| 6,431,363 | B1 * | 8/2002 | Hacker | B65D 5/5038 206/486 |
| 6,883,671 | B2 * | 4/2005 | Rushing | A47F 5/0018 206/736 |
| 7,861,865 | B2 | 1/2011 | Green | |
| 9,878,823 | B2 * | 1/2018 | Davis | B65D 43/14 |
| 2009/0014353 | A1 * | 1/2009 | Lewis, Jr. | B65D 25/107 206/776 |
| 2010/0147738 | A1 | 6/2010 | Green | |

* cited by examiner

DEPLOYABLE MERCHANDISE DISPLAY UNIT

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure relates generally to a display for merchandise, and more specifically to a display wherein merchandise can be easily transported and deployed on a sales floor.

2. Description of the Related Art

Oftentimes, for a retailer to promote sales within its store, the products and services offered for sale may be visibly displayed in an appealing manner intended to draw the attention of a consumer. Such desire to draw attention may lead to elaborate designs of a merchandise display used to display product on a sales floor. While the elaborate designs may achieve the goal of drawing the consumer's attention, such designs may be associated with certain deficiencies.

One particular deficiency is that the elaborate nature of the merchandise display may require a time-consuming process of assembling or constructing the merchandise display. Furthermore, the merchandise display may be configured such that the merchandise cannot be effectively loaded onto the merchandise display until after the display is set up on the sales floor. This may result in additional overtime labor expenses to complete the set up process when the retailer is closed, i.e., after business hours.

Another drawback associated with some merchandise displays is their overly bulky nature. Along these lines, such merchandise displays may not integrate well into the overall floor space of the retailer. Accordingly, merchandise displays may not efficiently use the space within the retailer establishment to accommodate consumers and may detract from the overall retail experience.

Yet another drawback associated with some merchandise displays is that the displays may not maintain an orderly appearance. For instance, the merchandise may become disheveled as consumers pick through the merchandise.

Another deficiency which may be associated with conventional merchandise displays is the restocking of merchandise on the display. Restocking may include reloading the display with the new merchandise, although this may be very time consuming and tedious, which may result in delayed restocking or disruption to the sales activities within the retailer.

Accordingly, there is a need in the art for an easily deployable display unit for displaying merchandise within a retail establishment. Various aspects of the present disclosure address this particular need, as will be discussed in more detail below.

BRIEF SUMMARY

In accordance with one embodiment of the present disclosure, there is provided a deployable display unit for rapidly displaying products for sale. The deployable display unit may include the ability to hold the products in an interior area of the display unit, and may be specifically sized and structured to allow for seamless transport and deployment of the display unit within a retailer. Subsequently, then the products have been removed from the display unit, the display unit may be easily removed and replaced with another display unit already stocked with additional products for sale.

According to one embodiment, there is provided a deployable display unit for displaying products for sale. The deployable display unit includes a peripheral wall extending around a central axis. The peripheral wall includes an end defining a base plane, a front panel, and a rear panel in opposed relation to each other. The front panel extends from the base plane to define a front height and the rear panel extends from the base plane to define a rear height greater than the front height. The deployable display unit additionally include at least one product support extends between the front panel and the rear panel. Each product support includes an upper panel, a lower panel, and a pair of side panels extending between the upper panel and the lower panel in opposed relation to each other to define a cavity. The display unit further includes a plurality of slots, with each slot extending through the upper panel and the pair of side panels. The product support is engageable with a plurality of products for sale, wherein each product for sale is received within a respective one of the plurality of slots when engaged with the at least one product support.

Each slot may extend within the upper panel to define a slot length, wherein the slot length of each of the plurality of slots may be substantially equal. A reference plane may extend perpendicularly between the front panel and the rear panel, and the plurality of slots may be staggered relative to the reference plane, such that the distance between the reference plane and each of the plurality of slots differs.

Each product support may be spaced from the base plane.

The peripheral wall may include a pair of side panels each extending in opposed relation to each other between the front panel and the rear panel, and each product support may be spaced from the pair of side panels.

The deployable display unit may include a bracing panel extending between the front panel and the rear panel.

The at least one product support may include a pair of product supports. The pair of product supports may be spaced from each other by a first distance, with the first distance being greatest at the front panel and smallest at the rear panel.

The front panel may include a front top edge and the rear panel may include a rear top edge, with the upper panel intersecting the front panel at the front top edge, and the upper panel being spaced from the rear top edge.

The front panel may include a front top edge and the rear panel includes a rear top edge, and the deployable display unit may further comprise an inclined wall extending from the front panel to the rear panel and including at least one opening aligned with the at least one product support.

The deployable display unit may include a cover positionable over the at least one product support.

According to another embodiment, there is provided a deployable display unit comprising a peripheral wall extending around a central axis. The peripheral wall includes an end defining a base plane, a front panel, and a rear panel in opposed relation to each other, the front panel extending from the base plane to define a front height and the rear panel extending from the base plane to define a rear height greater than the front height, the peripheral wall having an upper edge opposite the base plane. An inclined panel extend from the upper edge of the peripheral wall. A pair of product supports extend between the front panel and the rear panel in non-parallel relation to each other. Each product support includes a plurality of slots formed therein, with the plurality of slots being arranged in parallel relation to each other. Each product support is engageable with a plurality of products for sale, wherein each product for sale is received within a respective one of the plurality of slots when engaged with a respective one of the pair of product supports.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
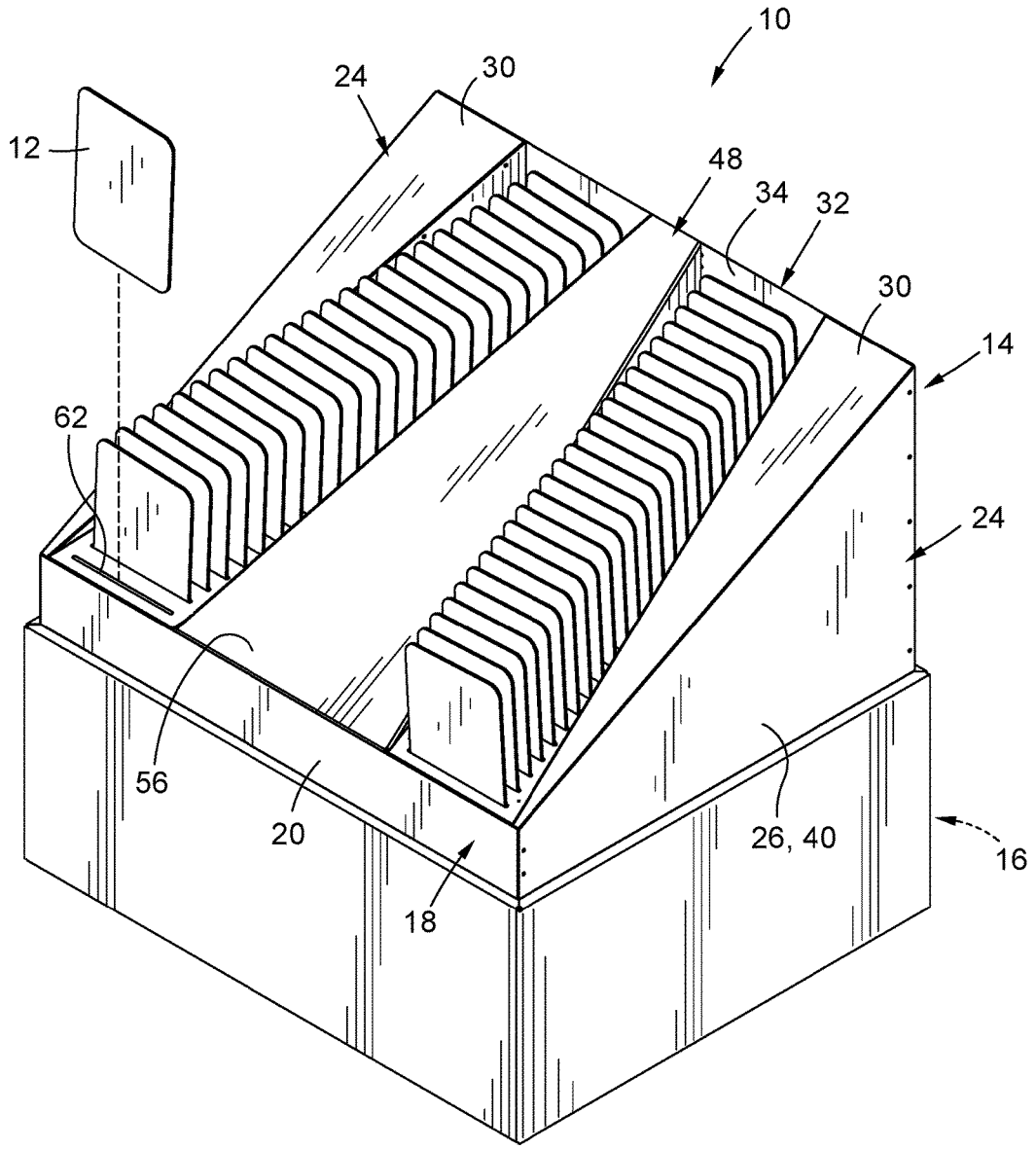
FIG. 1 is an upper perspective view of a deployable display unit constructed in accordance with an embodiment of the present disclosure, the deployable display unit having products placed within respective slots for display, the deployable display unit being placed on a stand depicted in phantom.

The detailed description set forth below in connection with the appended drawings is intended as a description of certain embodiments of a deployable display unit and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

Referring now to the drawings, wherein the showings are for purposes of illustrating a preferred embodiment of the present disclosure only, and are not for purposes of limiting the same, there is depicted a deployable display unit 10 for displaying merchandise or products 12 for sale on the floor of a retail establishment. The configuration of the deployable display unit 10 allows the products 12 to be stored therein for transport to the retail establishment and placement on the sales floor in the desired location. The deployable display unit 10 may be sized and dimensioned to allow for placement of the display unit 10 on a conventional pallet to facilitate transport of the display unit 10 onto the sales floor. Once all of the products 12 have been sold, the display unit 10 can be replaced with another display unit 10 stocked with new products 12. As such, a retailer can easily restock products 12 on the sales floor by replacing a depleted display unit 10 with a new, fully-stocked display unit 10.

FIG. 1 is an upper perspective view showing an exemplary embodiment of the deployable display unit 10 displaying a plurality of products 12 for sale. The deployable display unit 10 includes a main body 14 positioned on top of a secondary body 16, which may be used in connection with the main body 14 in different operational modes. In a first operational mode, the secondary body 16 may function as a cover, with the secondary body 16 placed over the main body 14 to cover the products 12 being held by the main body 14. In a second operational mode, the secondary body 16 may function as a stand, as shown in FIG. 1, with the main body 14 being positioned on top of the secondary body 16, to display the products 12 in a more elevated position.

Figure 2:
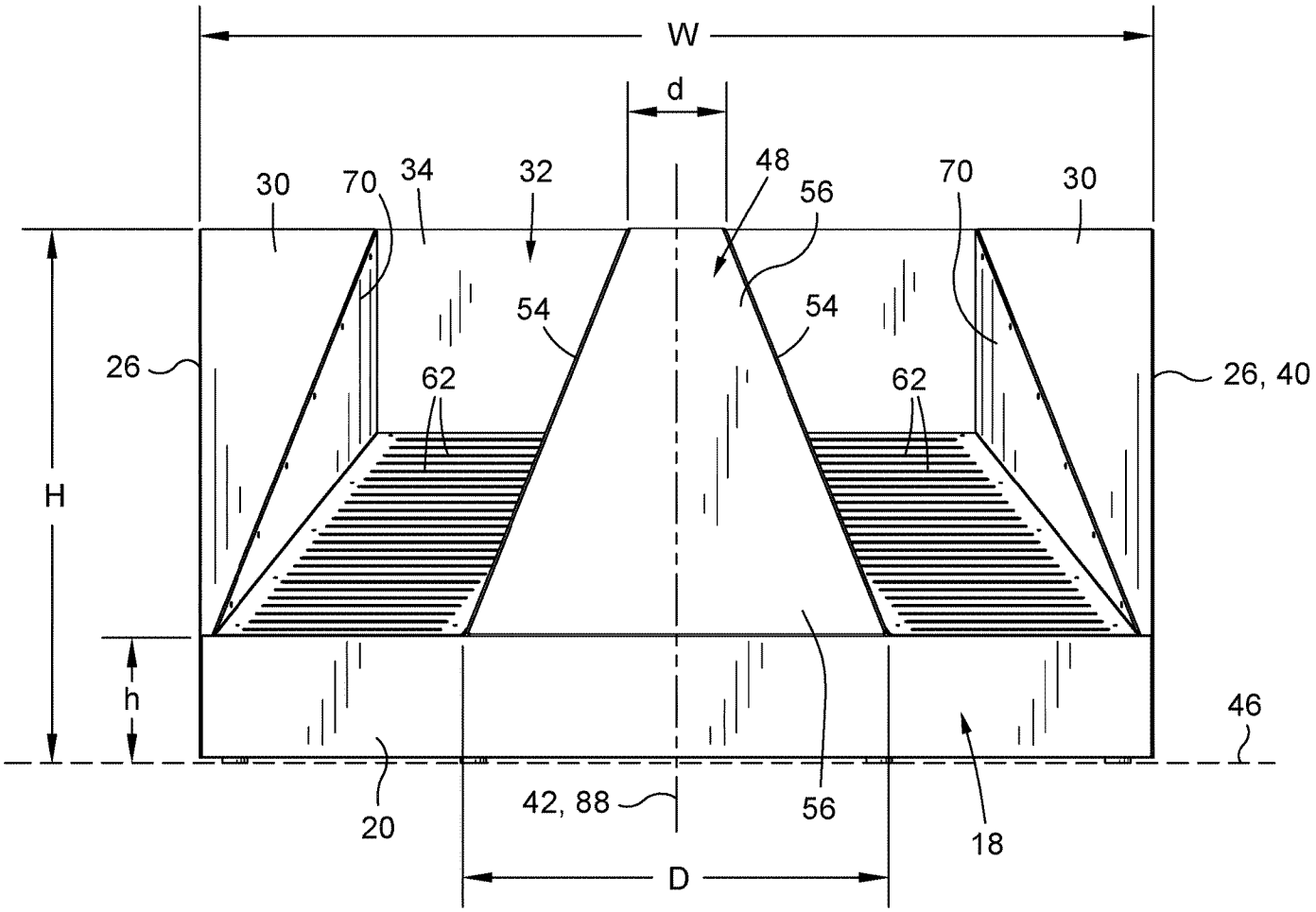
FIG. 2 is a front view of the deployable display unit.
Figure 3:
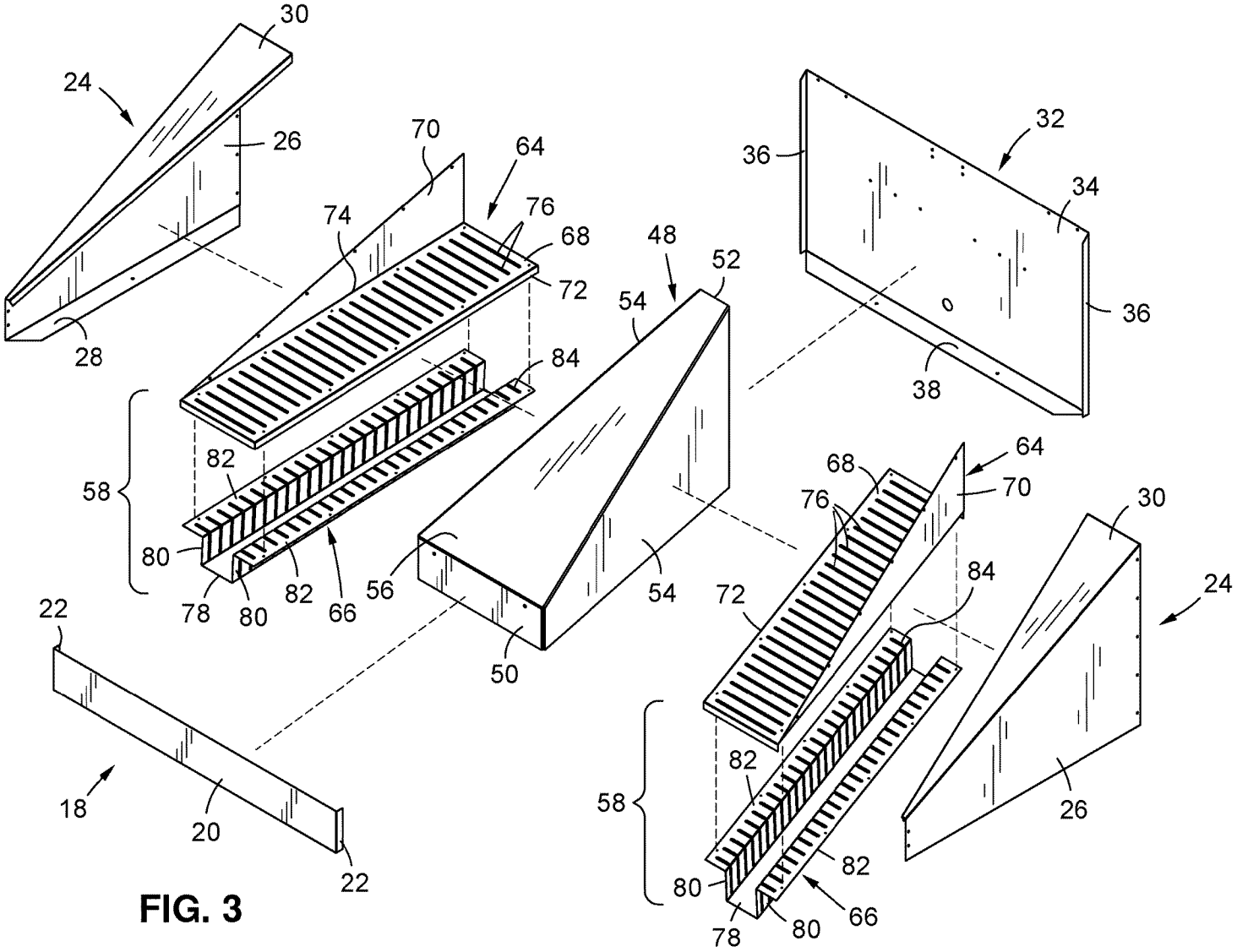
FIG. 3 is an exploded upper perspective view of the deployable display unit.
Figure 4:
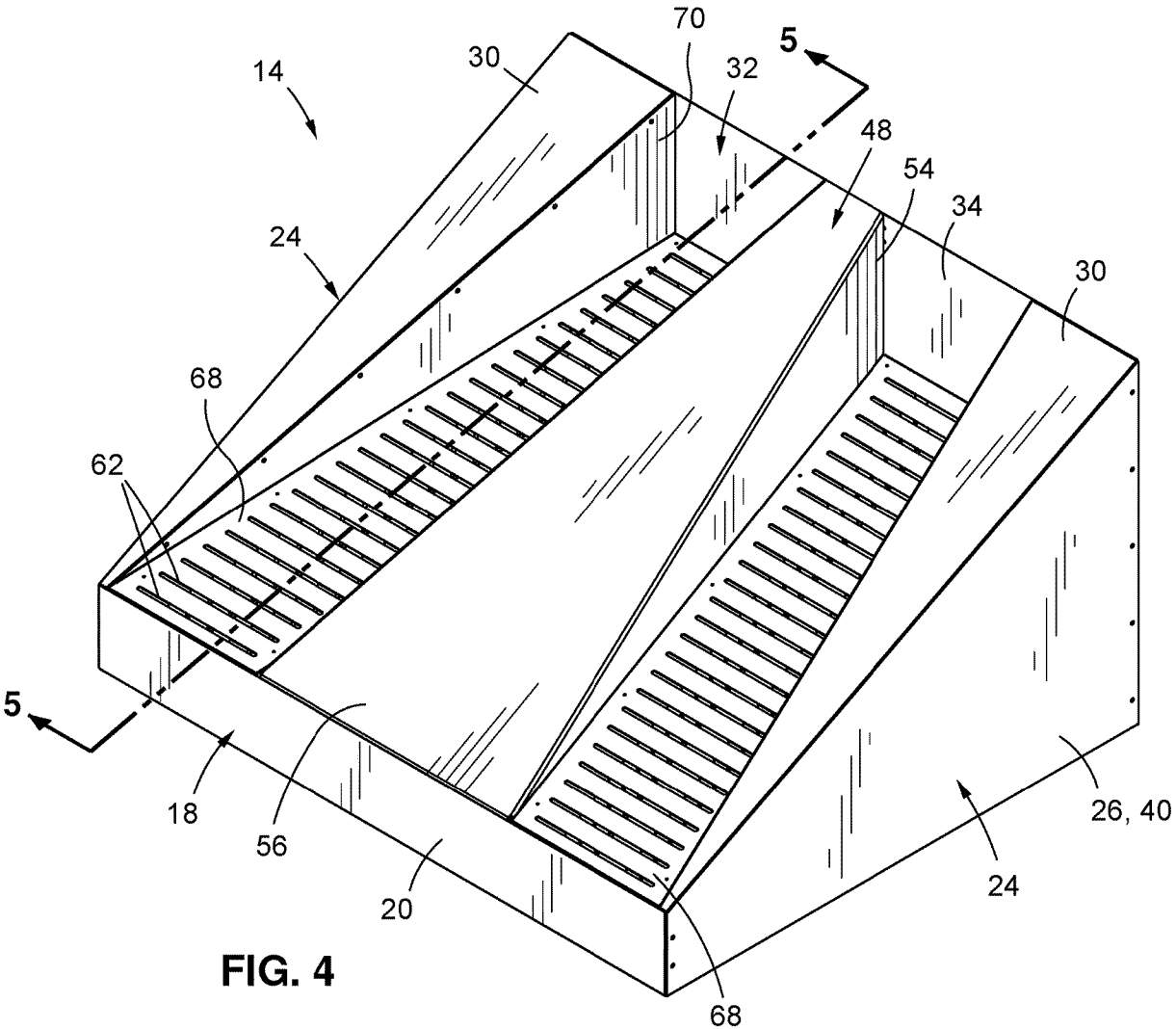
FIG. 4 is an assembled upper perspective view of the deployable display unit.
Figure 5:
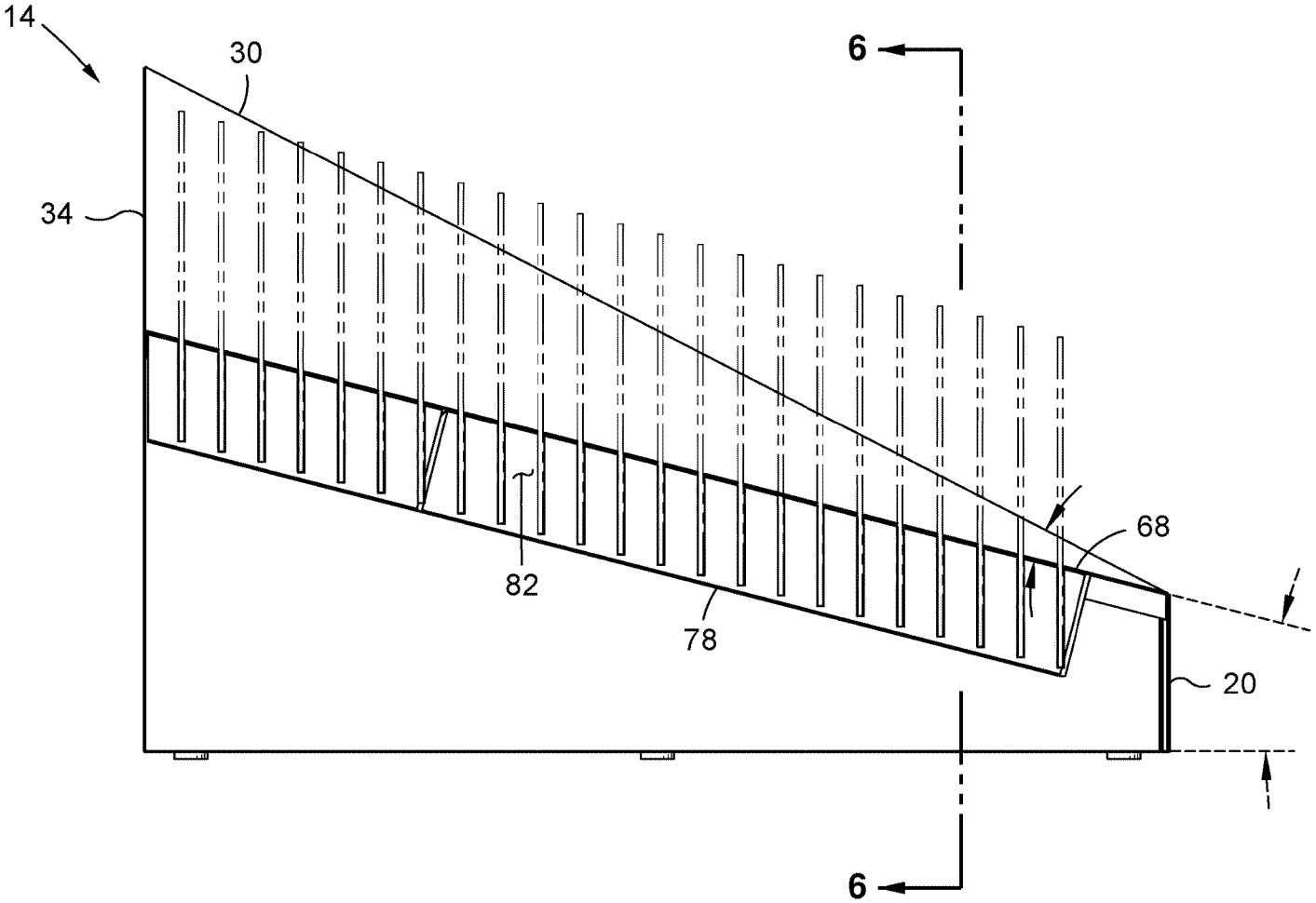
FIG. 5 is a side sectional view of the deployable display unit.
Figure 6:
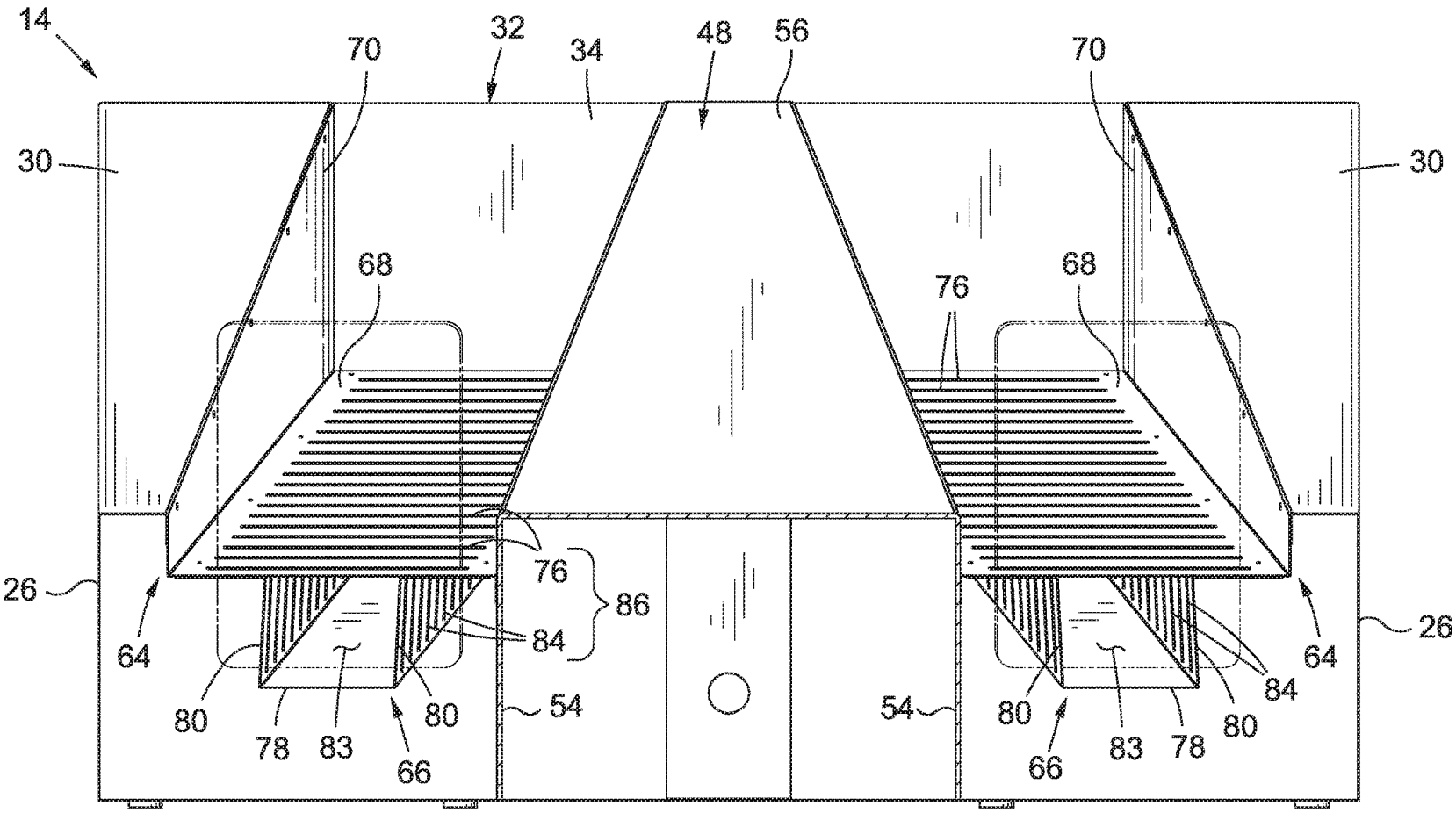
FIG. 6 is a front sectional view of the deployable display unit.
Figure 7:
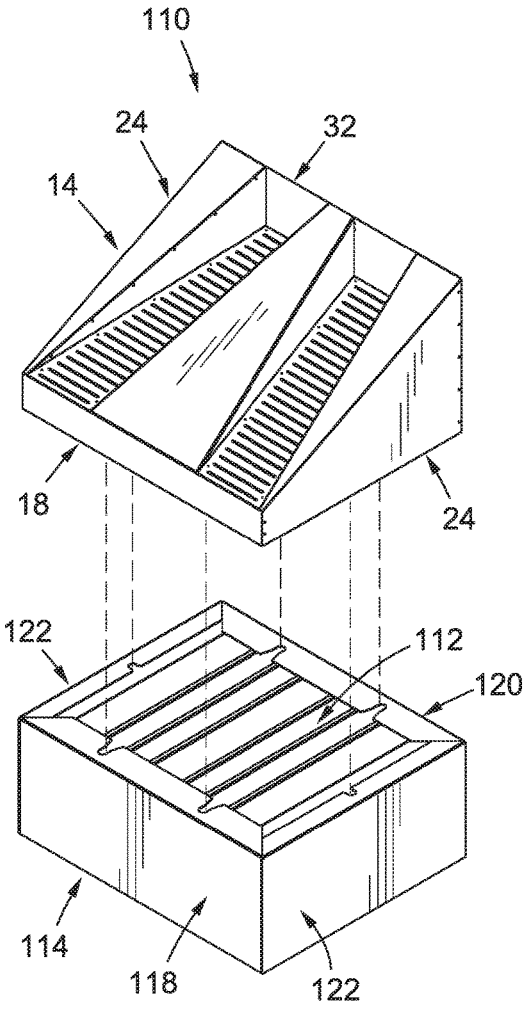
FIG. 7 is an upper perspective view of another embodiment of a deployable display unit including a main body, a pallet, and a display skirt.
Figure 8:
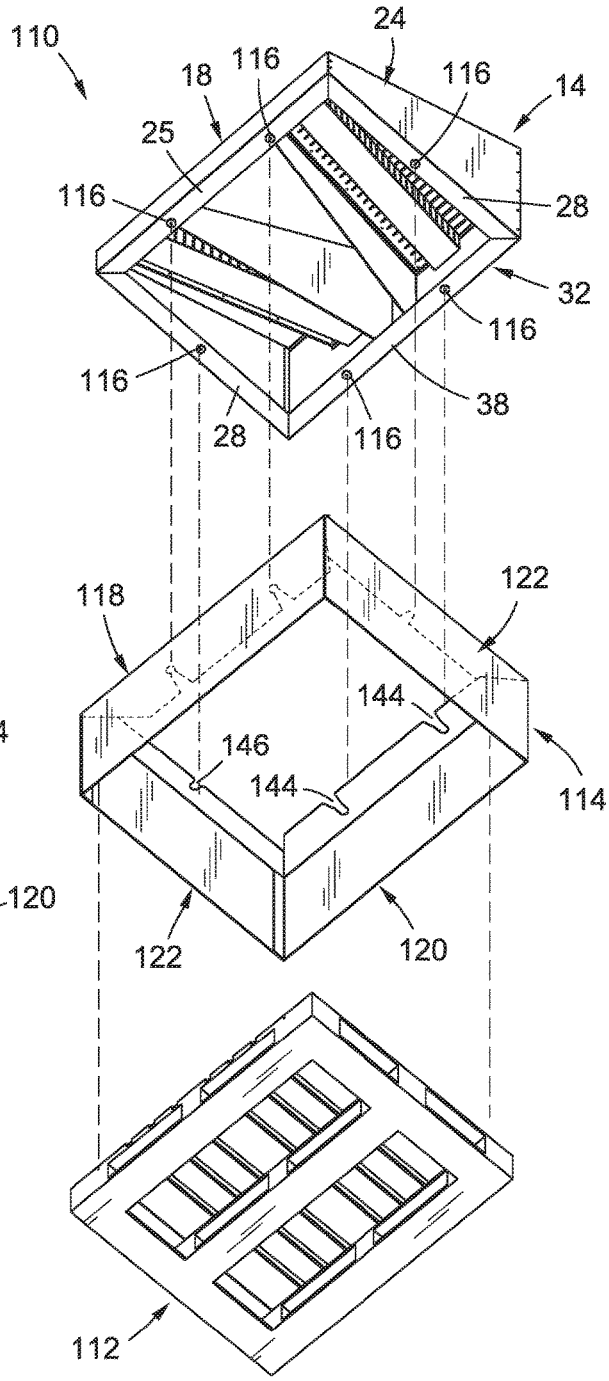
FIG. 8 is a lower exploded perspective view of the deployable display unit depicted in FIG. 7.
Figure 9:
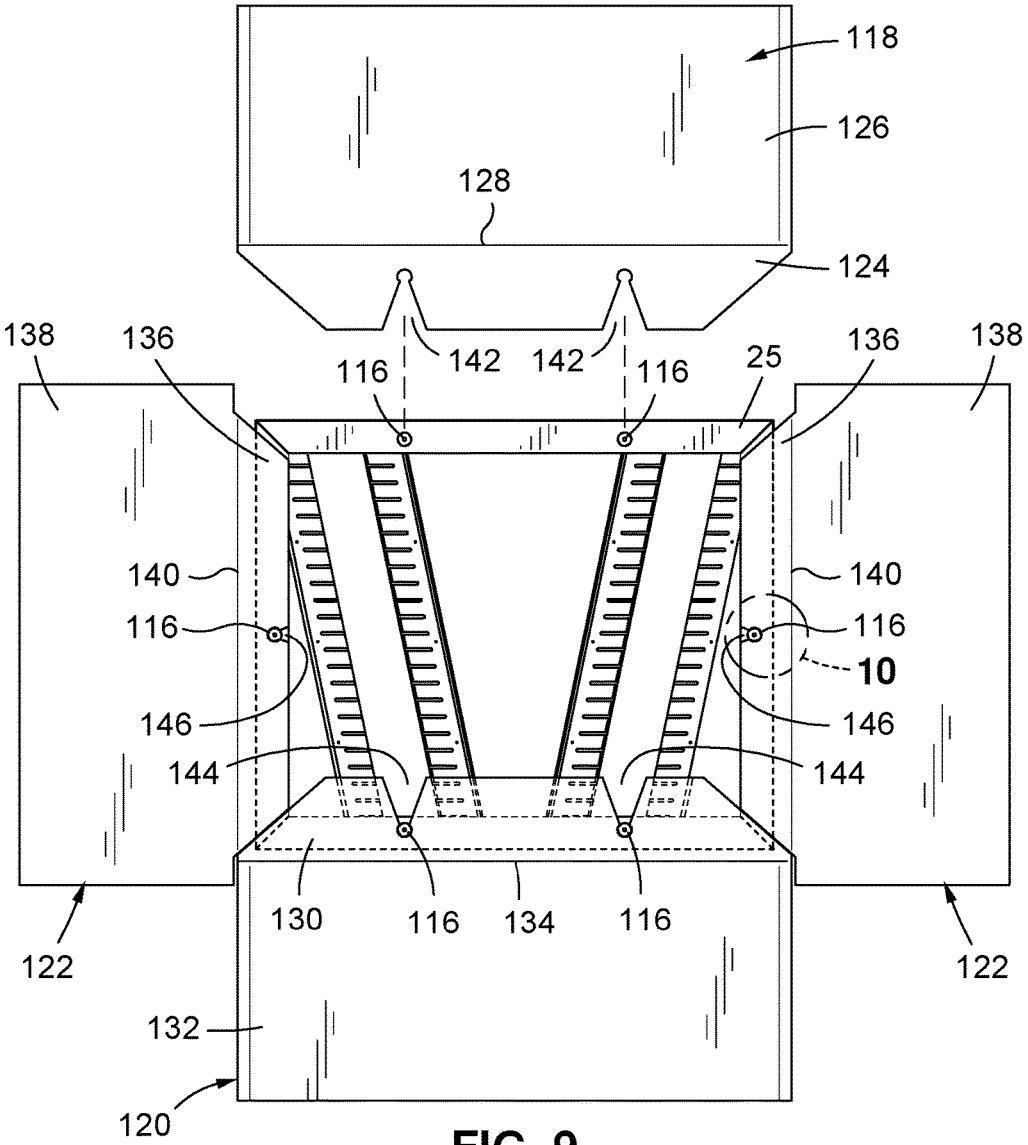
FIG. 9 is a bottom view illustrating attachment of the display skirt to the main body.
Figure 10:
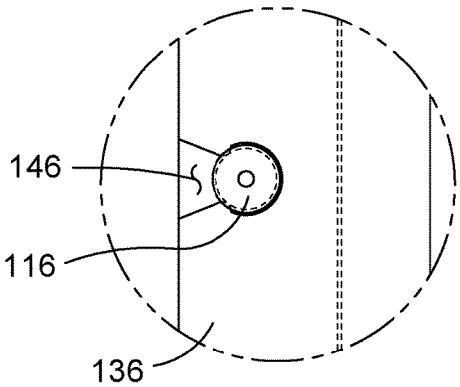
FIG. 10 is an enlarged bottom view of a portion of FIG. 9 illustrating engagement between the display skirt and main body via a mounting post.

FIG. 2 is a front view of the main body 14, while FIG. 3 is an exploded upper perspective view of the main body 14. In the exemplary embodiment depicted in FIG. 3, the main body 14 is comprised of a front component 18 having a front panel 20 and a pair of front flanges 22 extending from opposed ends of the front panel 20. Each front flange 22 is connected to a respective side component 24 comprising a side panel 26, a lower flange 28 and an inclined panel 30. The lower flange 28 and the inclined panel 30 may extend generally perpendicularly from the side panel 26, with the inclined panel 30 being angled relative to the lower flange 28. The front flange 22 may be connected to the side panels 26 via mechanical fasteners, such as rivets, nails, or the like. The pair of side panels 26 define a width, "W," and in one embodiment the width W is approximately equal to 47 inches.

Extending between the pair of side components 24 is a rear component 32, which includes a rear panel 34, a pair of side flanges 36, and a lower flange 38. Each side flange 36 may be connected to a respective side panel 26 via mechanical fasteners, while the bottom flange 38, along with the lower flanges 28 of the side components 24, may provide stability and support to the main body 14 when the main body 14 is placed on an underlying support surface.

When the main body 14 is assembled, with the front and rear components 18, 32 attached to the side components 24, the front panel 20, side panels 26, and rear panel 34 collectively define a peripheral wall 40 of the main body 14, which extends around a central axis 42. The peripheral wall 40 includes an end 44 defining a base plane 46, which may be generally perpendicular to the central axis 42. The front panel 20 extends from the base plane to define a front height "h" and the rear panel 34 extends from the base plane to define a rear height "H" greater than the front height h. In one embodiment, the front height h is approximately equal to 6", while the rear height is approximately equal to 26". The main body 14, and specifically, the peripheral wall 40, may be sized and dimensioned to allow the main body 14 to fit on a standard pallet. For instance, pallets are commonly available in the following sizes: 48"×40", 42"×42", and 48"×48". For instance, in the case of use on a 48"×40" pallet, the peripheral wall 40 may be dimensioned slightly smaller than the pallet, such as 47"×39". Those skilled in the art will readily appreciate that the dimensions provided herein are exemplary only, and the scope of the present disclosure is not limited thereto.

Although the exemplary embodiment includes a peripheral wall 40 that is quadrangular in shape, it is contemplated that other embodiments may include a peripheral wall 40 that is of different shapes and configurations, including oval, pentagon, hexagon, triangles, etc.

The main body 14 further includes an intermediate component 48 including a front panel 50, a rear panel 52, a pair of bracing panels 54, and an inclined panel 56. The intermediate component 48 is positioned between the front component 18 and the rear component 32, and between the pair of side components 24, and may provide internal structural support to the main body 14.

The front panel 20 of the front component 18 extends over the front panel 50 of the intermediate component 48, and the rear panel 34 of the rear component 32 extends over the rear panel 52 of the intermediate component 48. The pair of bracing panels 54 are spaced from the pair of side components 24, and are positioned in non-parallel relation to each other, such that the distance between the pair of bracing panels 54 decreases from the front panel 50 to the rear panel 34. In particular, the pair of bracing panels 54 are spaced apart from each other by a distance, "D," adjacent the front panel 50, and a distance, "d," adjacent the rear panel 34. In one embodiment, the distance D is equal to approximately 21-23 inches, while the distance d is equal to approximately 4-6 inches. The inclined panel 56 extends between the front panel 50 and the rear panel 34. According to one embodiment, the inclined panel 56 is generally co-planar with the inclined panels 30 of the side components 24.

The deployable display unit 10 additionally includes at least one product support 58 for supporting products within the display unit 10 in a position which favorably displays the products to potential customers. In the exemplary embodiment, the products which the deployable display unit 10 is specifically sized and structured to display are cards 12 associated with a merchandise item, which may be large or expensive, wherein a customer who wants to purchase the merchandize item takes a card 12 from the display unit 10 to the cash register to pay for the merchandise item. Once the item has been paid for, arrangements can be made with the customer for taking possession of the merchandise item. In this regard, rather than stocking the sales floor with large items or expensive items, which may take a lot of space, or make expensive items more susceptible to shoplifting, a retailer can keep such items in a more secure storage location, while still allowing customers to purchase such items through the use of the cards 12. As will be discussed in more detail below, the cards 12 associated with the merchandise may be inserted within respective slots 62 formed in the display unit 10 to display the cards 12 in an easy-to-see arrangement. Although the exemplary embodiment is shown for use with take-to-counter cards 12, it is understood that other products may be used with the display unit 10.

According to one embodiment, each product support 58 is spaced from the base plane 46 and extends between the front panel 20 of the front component 18 and the rear panel 34 of the rear component 32, as well as being positioned between the intermediate component 48 and a respective side component 24. In the exemplary embodiment, the display unit 10 includes a pair of product supports 58, although it is contemplated that the scope of the present disclosure is not limited to a particular number of product supports 58 within a given display unit 10.

According to one embodiment, each product support 58 includes an upper body 64 and a lower body 66. The upper body 64 includes an upper panel 68 and an upper flange 70 extending from the upper panel 68. The upper panel may extend from a top edge of the front panel 20 and a middle portion of the rear panel 34, i.e., spaced from a top edge of the rear panel. Each upper panel 68 may include a medial edge 72 and a lateral edge 74, with the medial edge 72 extending along a respective bracing panel 54 of the intermediate component 48 and the lateral edge 74 extending opposite the bracing panel 54. In view of the angled configuration of the bracing panel 54 relative to the front panel 20, the medial edge 72 is also angled relative to the front panel 20. Furthermore, the lateral edge 74 may be parallel to the medial edge 72, and angled relative to the front panel 20. The upper panel 68 may include a plurality of upper slot portions 76 formed therein, with the upper slot portions being arranged in generally parallel relation to each other and extending generally parallel to the front panel 20 and the rear panel 34. Each upper slot portion 76 may be equally spaced from the medial edge 72 and the lateral edge 74 of the corresponding upper panel 68. In this regard, the upper slot portions 76 may be arranged in a "staggered" arrangement, wherein the upper slot portions 76 closest to the rear panel 34 are closest to the central axis 42, while the upper slot portions 76 closest to the front panel 20 are furthest from the central axis 42.

The upper flange 70 extends upwardly from the upper panel 68 to the inclined panel 30 of the adjacent side component 24, in opposed relation to the bracing panel 54. In one embodiment, the upper flange 70 is triangular in shape and defines a height that is smallest adjacent the front panel 20 and greatest adjacent the rear panel 34. According to one embodiment, the upper flange 70, rear panel 34, bracing panel 54, and upper panel 68 collective define a recess within which the cards 12 may be displayed. The exemplary embodiment includes a pair of converging recesses in a front-to-rear direction, for displaying the cards 12 in an internal portion of the main body 14, while also providing a visually striking aesthetic, which draws the attention of the consumer.

The lower body 66 includes a lower panel 78, a pair of side panels 80, and a pair of flanges 82 extending from respective ones of the pair of side panels 80. The pair of flanges 82 may be placed adjacent the upper panel 68, with the pair of side panels 80 extending between the upper panel 68 and the lower panel 78 in opposed relation to each other to define a cavity 83. The cavity 83 may extend from the front panel 20 to the rear panel 34. The lower body 66 may include a plurality of lower slot portions formed therein, with each lower slot portion 84 extending through the pair of upper flanges 82 and the pair of side panels 80. In one embodiment, each lower slot portion 84 terminates before reaching the lower panel 78.

The upper body 64 is coupled to the lower body 66 such that the upper slot portions 76 are aligned with respective lower slot portions 84 such that the upper slot portions 76 are in communication with respective ones of the lower slot portions 84, such that the upper slot portions 76 and lower slot portions 84 collectively define a plurality of slots 86. The product support 58 is engageable with a plurality of products for sale (e.g., the cards 12 in the exemplary embodiment) via the slots 86. In particular, each product for sale is received within a respective one of the plurality of slots 86 when engaged with the at least one product support 58.

As noted above in relation to the upper slot portions 76, the slots 86, being at least partially defined by the upper slot portions 76, may have a staggered configuration to create a desired arrangement of the products for sale. For instance, a reference plane 88 may extend generally perpendicularly between the front panel 20 and the rear panel 34 and generally parallel to the side panels 26. According to one embodiment, the reference plane 88 is located between the pair of side panels 26, with the display unit 10 being symmetrical about the reference plane 88. The plurality of slots 86 may be staggered relative to the reference plane, such that the distance between the reference plane 88 and each of the plurality of slots 86 differs. In particular, the slots 86 positioned adjacent the rear panel 34 are closest to the reference plane 88, while the slots 86 positioned adjacent the front panel 20 are furthest from the reference plane 88.

The main body 14 may be fabricated from many different materials, including but not limited to cardboard, metal, plastic, or other materials known in the art.

With the basic structure of the display unit 10 being described above, the following discussion will discuss an exemplary use of the display unit 10. A plurality of deployable display units 10 may be loaded with merchandise cards 12 by placing the merchandise cards 12 within respective slots 62 formed on the main body 14. The secondary body 16 may be placed over the main body 14 to enclose the merchandise cards 12 within an interior of the display unit 10. As such, when the secondary body 16 is placed over the main body 14, the display unit 10 may assume a generally cuboid configuration. In other words, the display unit 10 may include five generally planar faces, with the bottom optionally being open. The generally cuboid configuration allows the display units 10 to be efficiently stored prior to deployment on the sales floor.

When the retailer wants to place a display unit 10 on the sales floor, the display unit 10 may be placed on a pallet to allow the display unit 10 to be easily transported via a forklift to its desired location. When in the desired location, the forklift may place the pallet and display unit 10 on the sales floor, and remove the secondary body 16 from the main body 14 to uncover the cards 12. The cards 12 are presented in an appealing, orderly arrangement in a manner in which customers may easily take a card 12 for payment at a cash register to purchase the merchandise or service associated with the card 12.

When all of the cards 12 have been taken from the main body 14, the display unit 10 may be considered "depleted" and thus, the sales floor may require restocking. Such restocking may be quickly and easily achieved by replacing the depleted display unit 10 with a fully stocked display unit 10.

In addition to the foregoing, it is contemplated that the display unit 10 may allow for certain stacked configurations, which may provide further advantages or efficiencies. In particular, when the secondary body 16 is removed from the main body 14, it is contemplated that the main body 14 may be stacked on top of the secondary body 16, such that the secondary body 16 functions as a stand for the main body 14. As another alternative, the uncovered main body 14 may be stacked on top of another display unit 10, such that when the cards 12 are removed from the main body 14, restocking can occur quickly by removing the empty main body 14, and removing the secondary body 16 from the underlying display unit 10 to uncover the cards 12 in the stocked main body 14.

In this respect, the display unit 10 allows for easy, rapid deployment of items for sale. The form factor of the display unit 10 permits easy transport and storage of the stocked display units 10 prior to deployment on the retail floor. Furthermore, the size and shape of the display unit allows the display unit 10 to be easily transported on a standard pallet.

Referring now to FIGS. 7-11, additional embodiments of a deployable display unit 110 are depicted, which include a pallet 112 and display skirt 114 usable with the main body 14. In particular, the display skirt 114 may be placed under the main body 14 to elevate the main body 14 when placed on the sales floor. When the display skirt 114 is erected, the pallet 112 may remain on the underlying support surface (i.e., the floor), or alternatively, the pallet 112 may be elevated above the underlying support surface, as will be described in more detail below.

According to one embodiment, the display unit 110 includes a plurality of mounting posts 116 coupled to the lower flanges 25, 28, 38 of the front component 18, side components 24, and rear component 32. In the particular arrangement depicted in FIGS. 8 and 9, the lower flanges 25, 38 of the front and rear components 18, 32 each include a pair of mounting posts 116 coupled thereto, while the lower flanges 28 of the side components 24 each include a single mounting post 116 coupled thereto, and thus, the display unit 110 as a whole includes six mounting posts 116. According to one embodiment, the mounting posts 116 are coupled to the lower flanges 25, 28, 38 via bolts, rivets, adhesives, or other mechanical fasteners known in the art. The number and arrangement of mounting posts 116 may vary without departing from the spirit and scope of the present disclosure.

The display skirt 114 includes a front skirt component 118, a rear skirt component 120, and a pair of side skirt components 122. The front skirt component 118 includes a front attachment flange 124 and a front skirt panel 126 foldable relative to the front attachment flange 124 about a front fold axis 128. The rear skirt component 120 includes a rear attachment flange 130 and a rear skirt panel 132 foldable relative to the rear attachment flange 130 about a rear fold axis 134. Each side skirt 122 component includes a side attachment flange 136 and a side skirt panel 138 foldable relative to the corresponding side attachment flange 136 about a respective side fold axis 140.

Each skirt component 118, 120, 122 is contoured to operatively interface with at least one of the mounting posts 116. According to one embodiment, the attachment flange 124, 130, 136 of each skirt component 118, 120, 122 includes at least one groove 142, 144, 146 sized to receive a respective mounting post 116 to facilitate frictional engagement between the mounting post 116 and the skirt component 118, 120, 122. For instance, the front attachment flange 124 may include a pair of grooves 142 adapted to receive respective ones of the pair of mounting posts 116 connected to the lower flange 25 of the front component 18. The rear attachment flange 130 may include a pair of grooves 144 adapted to receive respective ones of the pair of mounting posts 116 connected to the lower flange 38 of the rear component 32. Each side attachment flange 136 may include a groove 146 adapted to receive the mounting post 116 connected to the lower flange 28 of a given side component 24.

Each of the grooves 142, 144, 146 formed in the front attachment flange 124, rear attachment flange 130, and side attachment flanges 136 may include an open end portion, a closed end portion, and a neck separating the open end portion and the closed end portion. Each groove 142, 144, 146 may have a variable width which decreases from the open end portion toward the neck. The closed end portion may have a semi-circular configuration that is of a radius corresponding to the radius of the mounting posts 116. The closed end portions are also sized and structured to receive a respective mounting post 116 and circumnavigate a majority of the mounting post 116 received in the closed end portion.

The display skirt 114 is assembled by moving each skirt component 118, 120, 122 toward the mounting post(s) 116 on the corresponding lower flange 25, 28, 38 (e.g., the front skirt component 118 is moved toward the mounting posts 116 on the lower flange 25 of the front component 18), with each mounting post 116 being received in a respective groove 142, 144, 146. As the skirt component 118, 120, 122 is moved toward the mounting post(s) 116, the mounting post(s) 116 are advanced within a corresponding groove 142, 144, 146 toward the neck, with the width of the groove 142, 144, 146 decreasing as the mounting post 116 advances through the groove 142, 144, 146 toward the neck.

The width of the groove 142, 144, 146 at the neck may be smaller than the diameter of the mounting post 116, and thus, sufficient force may be required to cause the display skirt component 118, 120, 122 to flex or bend around the mounting post 116 to allow the mounting post 116 to be received within the closed end portion. When the mounting post 116 is received within the closed end portion, the corresponding attachment flange 124, 130, 136 circumnavigates a majority of the mounting post 116 to secure the attachment flange 124, 130, 136 to the mounting post 116. As such, the main body 14 serves as the structure which provides support to the display skirt 114.

When deployed, the front skirt panel 126 may be folded relative to the front attachment flange 124, the rear skirt panel 132 may be folded relative to the rear attachment flange 130, and the side skirt panels 138 may folded relative to their corresponding side attachment flanges 136 by approximately 90 degrees. When all of the skirt panels 126, 132, 138 are folded, the skirt panels 126, 132, 138 may create the appearance of a continuous wall. In the exemplary embodiment, the erected skirt panels 126, 132, 138 create the appearance of a continuous, quadrangular wall.

Figure 11:
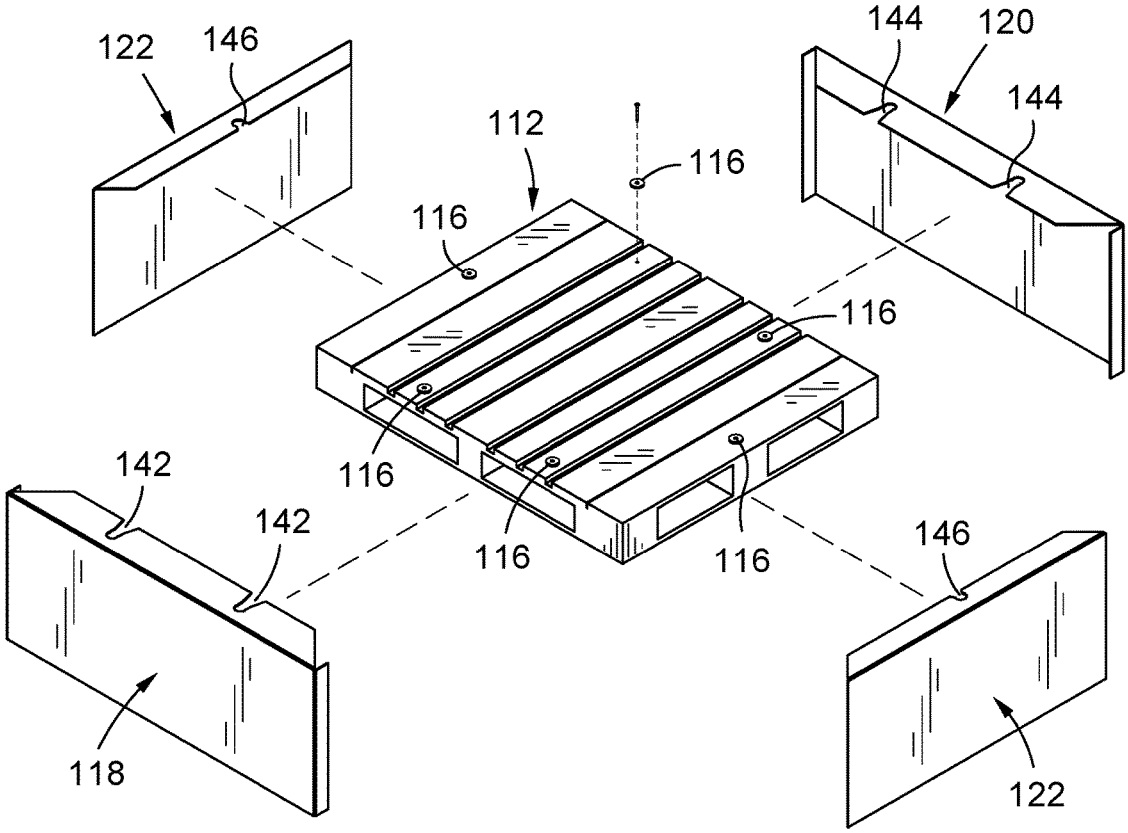
FIG. 11 is an upper perspective view of a pallet having mounting posts coupled thereto to facilitate engagement of the display skirt to the pallet.

In the foregoing embodiment, the mounting posts 116 are described as being attached to the lower flanges 25, 28, 38 of the front component 18, side components 24, and rear component 32. FIG. 11 shows another embodiment, wherein the mounting posts 116 are connected to the pallet 112. In this regard, the mounting posts 116 interface with the display skirt 114 in a similar manner described above, with the mounting posts 116 being received in the grooves 142, 144, 146 formed on the display skirt 114. As such, when the mounting posts 116 are connected to the pallet 112, the pallet 112 serves as the structure which provides support to the display skirt 114.

Those skilled in the art will appreciate that any dimension provided herein is an approximate value, and that the approximate value may allow for dimensional tolerances readily used in the art.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A deployable display unit for displaying products for sale, the deployable display unit comprising:

a peripheral wall extending around a central axis, the peripheral wall having an end defining a base plane, a front panel, and a rear panel in opposed relation to each other, a reference plane extends perpendicularly relative to the front panel and the rear panel and between the front panel and the rear panel, the front panel extending from the base plane to define a front height and the rear panel extending from the base plane to define a rear height greater than the front height; and at least one product support extending between the front panel and the rear panel, the product support having:

an upper panel;

a lower panel;

a pair of side panels extending between the upper panel and the lower panel in opposed relation to each other to define a cavity; and a plurality of slots, each slot extending through the upper panel and pair of side panels, the plurality of slots being staggered relative to the reference plane, such that the distance between the reference plane and each of the plurality of slots differs;

the product support being engageable with a plurality of products for sale, wherein each product for sale is received within a respective one of the plurality of slots when engaged with the at least one product support.

2. The deployable display unit recited in claim 1, wherein each slot extends within the upper panel to define a slot length, the slot length of each of the plurality of slots being substantially equal.

3. The deployable display unit recited in claim 1, wherein the product support is spaced from the base plane.

4. The deployable display unit recited in claim 1, wherein the peripheral wall includes a pair of side panels each extending in opposed relation to each other between the front panel and the rear panel, the product support being spaced from the pair of side panels.

5. The deployable display unit recited in claim 1, further comprising a bracing panel extending between the front panel and the rear panel.

6. The deployable display unit recited in claim 1, wherein the at least one product support includes a pair of product supports.

7. The deployable display unit recited in claim 6, wherein the pair of product supports are spaced from each other greatest at the front panel and smallest at the rear panel.

8. The deployable display unit recited in claim 1, wherein the front panel includes a front top edge and the rear panel includes a rear top edge, the upper panel intersecting the front panel at the front top edge, the upper panel being spaced from the rear top edge.

9. The deployable display unit recited in claim 1, wherein the front panel includes a front top edge and the rear panel includes a rear top edge, the deployable display unit further comprising an inclined wall extending from the front panel to the rear panel and including at least one opening aligned with the at least one product support.

10. The deployable display unit recited in claim 1, further comprising a cover positionable over the at least one product support.

11. The deployable display unit recited in claim 1, further comprising:

a plurality of mounting posts coupled to the peripheral wall; and a display skirt connectable to the plurality of mounting posts and capable of supporting the peripheral wall.

12. A deployable display unit comprising:

a peripheral wall extending around a central axis, the peripheral wall having an end defining a base plane, a front panel, and a rear panel in opposed relation to each other, the front panel extending from the base plane to define a front height and the rear panel extending from the base plane to define a rear height greater than the front height, the peripheral wall having an upper edge opposite the base plane;

an inclined panel extending from the upper edge of the peripheral wall; and a pair of product supports extending between the front panel and the rear panel in non-parallel relation to each other, each product support having a plurality of slots formed therein, the plurality of slots being arranged in parallel relation to each other;

each product support being engageable with a plurality of products for sale, wherein each product for sale is received within a respective one of the plurality of slots when engaged with a respective one of the pair of product supports.

13. The deployable display unit recited in claim 12, wherein a reference plane extends perpendicularly relative to the front panel and the rear panel and between the front panel and the rear panel, the plurality of slots being staggered relative to the reference plane, such that the distance between the reference plane and each of the plurality of slots differs.

14. The deployable display unit recited in claim 12, wherein each product support is spaced from the base plane.

15. The deployable display unit recited in claim 12, wherein the peripheral wall includes a pair of side panels each extending in opposed relation to each other between the front panel and the rear panel, each product support being spaced from the pair of side panels.

16. The deployable display unit recited in claim 12, wherein the pair of product supports are spaced from each other greatest at the front panel and smallest at the rear panel.

17. The deployable display unit recited in claim 12, further comprising an inclined wall extending from the front panel to the rear panel and including at least one opening aligned with the at least one product support.

18. The deployable display unit recited in claim 12, further comprising:

a plurality of mounting posts coupled to the peripheral wall; and a display skirt connectable to the plurality of mounting posts and capable of supporting the peripheral wall.

19. A deployable display unit for displaying products for sale, the deployable display unit comprising:

a peripheral wall extending around a central axis, the peripheral wall having an end defining a base plane, a front panel including a front top edge, and a rear panel in opposed relation to the front panel and including a rear top edge, the front panel extending from the base plane to define a front height and the rear panel extending from the base plane to define a rear height greater than the front height; and at least one product support extending between the front panel and the rear panel, the product support having:

an upper panel intersecting the front panel at the front top edge, the upper panel being spaced from the rear top edge;

a lower panel;

a pair of side panels extending between the upper panel and the lower panel in opposed relation to each other to define a cavity; and a plurality of slots, each slot extending through the upper panel and pair of side panels;

the product support being engageable with a plurality of products for sale, wherein each product for sale is received within a respective one of the plurality of slots when engaged with the at least one product support.

20. A deployable display unit for displaying products for sale, the deployable display unit comprising:

a peripheral wall extending around a central axis, the peripheral wall having an end defining a base plane, a front panel, and a rear panel in opposed relation to each other, the front panel extending from the base plane to define a front height and the rear panel extending from the base plane to define a rear height greater than the front height; and a pair of product supports extending between the front panel and the rear panel, each product support having:

an upper panel;

a lower panel;

a pair of side panels extending between the upper panel and the lower panel in opposed relation to each other to define a cavity; and a plurality of slots, each slot extending through the upper panel and pair of side panels;

the product support being engageable with a plurality of products for sale, wherein each product for sale is received within a respective one of the plurality of slots when engaged with the at least one product support;

the pair of product supports being spaced from each other greatest at the front panel and smallest at the rear panel.

21. A deployable display unit for displaying products for sale, the deployable display unit comprising:

a peripheral wall extending around a central axis, the peripheral wall having an end defining a base plane, a front panel including a front top edge, and a rear panel in opposed relation to the front panel and including a rear top edge, the front panel extending from the base plane to define a front height and the rear panel extending from the base plane to define a rear height greater than the front height;

at least one product support extending between the front panel and the rear panel, the product support having:

an upper panel;

a lower panel;

a pair of side panels extending between the upper panel and the lower panel in opposed relation to each other to define a cavity; and a plurality of slots, each slot extending through the upper panel and pair of side panels;

the product support being engageable with a plurality of products for sale, wherein each product for sale is received within a respective one of the plurality of slots when engaged with the at least one product support; and an inclined wall extending from the front panel to the rear panel and including at least one opening aligned with the at least one product support.

22. A deployable display unit for displaying products for sale, the deployable display unit comprising:

a peripheral wall extending around a central axis, the peripheral wall having an end defining a base plane, a front panel, and a rear panel in opposed relation to each other, the front panel extending from the base plane to define a front height and the rear panel extending from the base plane to define a rear height greater than the front height;

a plurality of mounting posts coupled to the peripheral wall;

a display skirt connectable to the plurality of mounting posts and capable of supporting the peripheral wall; and at least one product support extending between the front panel and the rear panel, the product support having:

an upper panel;

a lower panel;

a pair of side panels extending between the upper panel and the lower panel in opposed relation to each other to define a cavity; and a plurality of slots, each slot extending through the upper panel and pair of side panels;

the product support being engageable with a plurality of products for sale, wherein each product for sale is received within a respective one of the plurality of slots when engaged with the at least one product support.

* * * * *